United States Patent [19]

Delagi et al.

[11] Patent Number: 5,015,533

[45] **Date of Patent: * May 14, 1991**

[54] MEMBER OF A REFRACTORY METAL MATERIAL OF SELECTED SHAPE AND METHOD OF MAKING

[75] Inventors: Richard G. Delagi, Sharon, Mass.; George Trenkler, East Providence, R.I.

[73] Assignee: Texas Instruments Incorporated, Dallas, Tex.

[ * ] Notice: The portion of the term of this patent subsequent to Dec. 5, 2006 has been disclaimed.

[21] Appl. No.: 247,799

[22] Filed: Sep. 22, 1988

Related U.S. Application Data

[63] Continuation-in-part of Ser. No. 166,300, Mar. 10, 1988, Pat. No. 4,885,214.

[51] Int. Cl.[5] ..... B22F 7/02

[52] U.S. Cl. ..... 428/549; 428/614; 419/8; 419/9; 419/38; 419/45

[58] Field of Search ..... 419/8, 9, 38, 45; 428/549, 614

[56] References Cited

U.S. PATENT DOCUMENTS

| | | | |
|---|---|---|---|
| 1,125,162 | 1/1915 | Page | 191/4 |
| 2,358,326 | 9/1944 | Hensel et al. | 75/22 |
| 2,370,242 | 9/1945 | Hensel et al. | 75/22 |
| 3,097,329 | 6/1961 | Siemens | 317/234 |
| 3,113,376 | 12/1963 | Pflumm et al. | 29/471.1 |
| 3,220,107 | 11/1965 | Clark | 29/474.1 |
| 3,295,935 | 1/1967 | Pflumm et al. | 29/183.5 |
| 3,399,332 | 8/1968 | Savolainen | 317/234 |
| 3,403,999 | 10/1968 | Bliss | 75/208 |
| 3,406,446 | 10/1968 | Muldovan | 29/497.5 |
| 3,555,265 | 1/1971 | Feller | 204/10 |
| 3,682,606 | 8/1972 | Anderson et al. | 29/196.2 |
| 3,826,172 | 7/1974 | Dawson | 89/36 A |
| 4,158,719 | 6/1979 | Frantz | 428/567 |
| 4,283,464 | 8/1981 | Hascoe | 428/594 |
| 4,472,762 | 9/1984 | Spinelli et al. | 361/386 |
| 4,569,692 | 2/1986 | Butt | 75/235 |
| 4,613,369 | 9/1986 | Koehler | 75/246 |
| 4,647,022 | 3/1987 | Coble | 266/282 |
| 4,652,171 | 3/1987 | Coble | 29/455 |
| 4,680,618 | 7/1987 | Kuroda | 337/74 |
| 4,885,214 | 12/1989 | Trenker et al. | 428/614 |
| 4,889,776 | 12/1989 | Priceman | 428/629 |
| 4,894,293 | 1/1990 | Breit et al. | 428/614 |

FOREIGN PATENT DOCUMENTS

| | | |
|---|---|---|
| 3601707-A | 4/1986 | Fed. Rep. of Germany . |
| 57-054236 | 2/1982 | Japan . |

OTHER PUBLICATIONS

J. D. Destefani, "Advances in Intermetallics", Advanced Metals & Process 2/89, pp. 37–41.

*Primary Examiner*—Stephen J. Lechert, Jr.
*Attorney, Agent, or Firm*—James P. McAndrews; John A. Haug; Melvin Sharp

[57] ABSTRACT

A member of selected shape embodying a refractory metal material such as a titanium aluminide preferably having reinforcing elements disposed therein is provided by combining constitutents of the refractory metal material surrounding the reinforcing elements, by consolidating the constituents and elements and forming them into the selected shape, and by reacting the constituents with each other for forming the refractory metal material in situ within the selected shape, at least one of the constituents also preferably being reacted in situ within the selected shape with metal material of the reinforcing elements for forming an intermetallic compound which securely holds the reinforcing elements in position within the selected shape.

20 Claims, 3 Drawing Sheets

MEMBER OF A REFRACTORY METAL MATERIAL OF SELECTED SHAPE AND METHOD OF MAKING

This application is a continuation-in-part of a commonly assigned copending application of the present inventors, Ser. No. 07/166,300 now U.S. Pat. No. 4,885,214 filed Mar. 10, 1988 entitled Composite Material and Method For Making.

BACKGROUND OF THE INVENTION

The field of this invention is that of members of refractory metal materials of selected shape and of methods of making such members.

There are many metallic materials in which different metals are combined with each other or other materials to achieve desirable properties such as low density with high strength, good corrosion (oxidation) resistance, or good retention of selected properties such as high strength at high temperatures wherein the materials have not been adapted to be fabricated by conventional forging means and the like such as rolling, drawing and stamping because of their lack of intrinsic ductility for example. Exemplary of such metallic materials of great interest to the aerospace industry are refractory metal materials such as beryllides and aluminides, particularly intermetallic compounds of titanium and aluminum having ordered crystalline structures of definite composition which, due to lack of slip directions in the lattice structures of these materials, have not been compatible with conventional forming technology.

It has also been frequently proposed to incorporate reinforcing elements such as metal fibers or the like within various materials for providing members formed from the materials with greater strength. However such members have frequently been characterized by the relatively low strength of the bond between the elements and the materials being reinforced such that the members are typically not adapted to be shaped after the reinforcing elements have been introduced into the materials. In that regard, the desirability of introducing reinforcing elements into the refractory metal materials noted above has been recognized but as yet members embodying such refractory materials having adequate reinforcing means therein have not been capable of being formed by use of the forging steps and the like noted above conventionally used in forming members of metal materials.

SUMMARY OF THE INVENTION

It is an object of this invention to provide novel and improved members of selected shape embodying refractory metal materials; to provide such members having reinforcing means therein; to provide such members of selected shape having the refractory metal materials thereof securely bonded to reinforcing means within the selected shape; to provide such members wherein the refractory metal materials comprise ordered intermetallic compounds; to provide such members wherein the refractory metal materials are securely bonded to the reinforcing means by formation of intermetallic compounds between constituents of the refractory metal materials and the reinforcing means; to provide such members embodying titanium aluminide materials; and to provide novel and improved methods for making such members.

Briefly described, the novel and improved members of this invention comprise a refractory metal material having a plurality of constituents, the member having a selected shape. Preferably for example the refractory metal material comprises an ordered intermetallic compound such as a beryllide or aluminide. In one preferred embodiment, the refractory metal material comprises a titanium-aluminum alloy selected from the group consisting of alpha titanium aluminide and gamma titanium aluminide. Preferably the member incorporates reinforcing means such as a plurality of wire elements with or without a metal cladding thereon dispersed in the refractory metal material throughout the selected shape. Desirably a wire mesh is disposed in the refractory metal material and extends throughout the selected shape in one preferred embodiment of the invention. Preferably the metal reinforcing means is secured in position within the selected shape by an intermetallic compound formed between the reinforcing means and the constituents of the refractory metal material.

In the method provided by this invention for making the improved member of selected shape, the constituents of the refractory metal material are combined in metal powder form, preferably around a metal reinforcing means. The powders and reinforcing means are then consolidated and formed in selected shape preferably by forging means such as rolling, stamping or drawing or the like. The materials of the powders are then chemically reacted, or fused by sintering if previously reacted, with each other in situ within the selected shape for producing the refractory metal material. Preferably the reinforcing means dispersed or extending throughout the selected shape is also reacted with the powdered materials for forming an intermetallic compound between the powdered materials and the reinforcing means for securing the reinforcing means in position within the selected shape, such an intermetallic to vary from one rich in the reinforcing material to one rich in the powdered material as desired.

DESCRIPTION OF THE DRAWINGS

Other objects, advantages, features and details of the novel and improved members and methods of this invention appear in the following detailed description of preferred embodiments of the invention, the detailed description referring to the drawings in which.

DESCRIPTION OF THE PREFERRED EMBODIMENTS

Figure 3A:
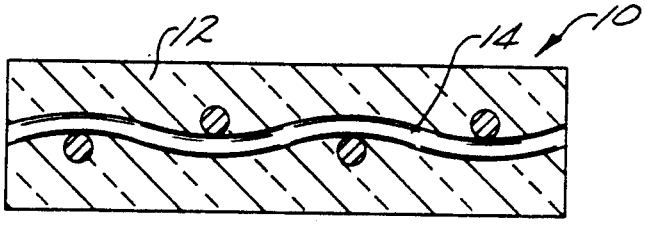
FIG. 3A, 3B and 3C are section views similar to FIGS. 2A, 2B and 2C respectively illustrating a preferred embodiment of the novel member of refractory metal material of selected shape provided by this invention.

Referring to the drawings, 10 in FIG. 3A for example indicates one preferred embodiment of the novel member of this invention which is shown to have a selected shape—in this case the shape of a thin metal sheet—embodying a refractory metal material 12 having at least two constituents which surrounds a reinforcing means 14 extending throughout the selected shape of the member. That is, the member embodies a metal material 12 which is characterized by being relatively difficult to fuse or bond to other metals, to roll, or to draw, bend or otherwise shape by use of forging processes such as a rolling, stamping or drawing or other conventional forming technologies even at relatively high temperatures as compared with other metal materials formed by such technologies. Typically, the refractory metal material 12 comprises a beryllide or aluminide characterized by low density and high strength suitable for use in the aerospace industry and, in one preferred embodiment of the invention, the refractory metal material 12 comprises a titanium aluminide embodying an intermetallic compound having an ordered crystalline structure if definite composition selected from the group consisting of alpha titanium aluminide (Ti AL) and gamma titanium aluminide (Ti AL). Preferably the reinforcing means 14 comprises a metal reinforcing means such as a woven wire mesh illustrated in FIG. 3A which has a portion extending throughout the selected shape of the member 10 so that portions of the reinforcing mesh are dispersed throughout the shape. The metal material of the reinforcing means 14 preferably comprises a metal material selected from the group consisting of molybdenum, tungsten, titanium, aluminum, steels including stainless steels, nickel and other nickel alloys or the like. It should be understood that the reinforcing means 14 can also be omitted from the member 10 in alternate embodiments within the scope of this invention.

In accordance with this invention, the refractory metal material 12 is formed in situ within the selected shape provided for the member 10. Preferably, for example, the member 10 is made using the novel and advantageous process which is diagrammatically illustrated in FIG. 1. That is, a plurality of constituents **12*a* and 12*b* of the refractory metal material are dispensed in powder form from supplies as indicated at 16 to be combined in substantially stoichiometric amount or the like in a hopper 18 and thoroughly mixed as diagrammatically indicated at 20 to provide a homogeneous mixture of the plurality of constituents in finely divided form to be dispensed from the hopper as indicated at 12*c* in FIG. 1. If desired, a binder and/or slurry-forming material 12*d* is dispensed from a supply as indicated at 22 as may be desired to be incorporated in the mixture 12*c* and thoroughly dispersed therein for facilitating further processing of the mixture as described below. However, depending on the nature of the constituents 12*a* and 12*b* such binder or slurry-forming materials may be omitted within the scope of this invention. Typically for example, in a preferred embodiment of the invention, finely divided titanium powders 12*a* are combined with corresponding aluminum powders 12*b* to form a substantially stoichiometric mixture 12*c*** or the like suitable for reaction with each other to form a titanium aluminide.

The mixture **12*c* is then combined with the reinforcing means 14 for surrounding the reinforcing means, and the metal powders of the mixtures are consolidated with each other and with the reinforcing means for forming the selected shape of the member 10. Preferably for example, a strip of woven metal wire mesh reinforcing means 14 is fed from a supply (not shown) to pass between a pair of compacting rolls 24 while the mixture 12 is also fed between the rolls through the guides 26 to surround the wire mesh and to be compacted around the mesh, thereby to consolidate the metal powders and the metal reinforcing means to form the selected sheet shape of the member 10. If the metal powders and metal materials of the reinforcing means are compacted without a binder and have adequate malleability, the compaction between the rolls 24 is preferably sufficient to produce incipient solid phase metallurgical bonds between the metal powders and/or between the powders and the reinforcing means. If desired, the wire mesh and the powder mixture are heated as diagrammatically illustrated at 28 for facilitating such consolidation. If the consolidation of the powders and reinforcing means is carried out using a binder, and the metal powders and wire mesh as consolidated by the compacting rolls are further compacted or consolidated by stamping or coining means or the like as is diagrammatically illustrated at 32 in FIG. 1. If desired, the consolidated materials are cut-off by conventional blanking or slitting means as indicated at 34 for providing the member with substantially its final selected shape as illustrated at 10*a*** in FIG. 2A.

In accordance with this invention, the metal powders in the mixture **12*c* are then reacted with each other for forming the refractory metal material 12 in situ within the selected shape of the metal member 10. Preferably for example the consolidated powders and mesh are heated for thermally reacting the metal powders in the formed shape 10*a* to form the desired refractory material of the member 10 as indicated at 36 in FIG. 1 and in that case the heating, and preferably the other process steps as well, are conducted in a protective atmosphere appropriate for the materials of the member 12 as is diagrammatically indicated by the housing 38 and by the means 39 for introducing such an atmosphere into the housing. It should be understood however that the energy introduced into the consolidated and formed powder and mesh materials for reacting the materials to form the refractory metal material 12 can be supplied by thermal, mechanical or electrical means or the like or any combination thereof. That is, the energy for reaction may be supplied by the forging means such as are used in roll bonding, stamping, explosive fabrication or the like or by hot isostatic pressing, by heating with electrical means, laser heating or welding means or the like or by ultrasonic bonding or the like within the scope of this invention, thereby to form the member 10** as illustrated in FIG. 3A.

EXAMPLE A

In one preferred embodiment of the invention, the refractory metal material 12 comprises alpha titanium aluminide (Ti AL) and the metal reinforcing means 14 comprises a woven mesh of a titanium alloy wire such as a wire having the nominal composition TiAL V, the member 10 being provided in thin sheet or foil shape as illustrated in FIG. 3A to provide the member with very low density and high strength suitable for use in aircraft skin applications or the like. In preparing such a sheet member in accordance with this invention a wire of such a titanium alloy having a diameter of about 0.020 inches would be woven to form a 24 by 24 wire mesh and a strip of the mesh of selected length would be advanced between compacting rolls with a mixture of titanium and aluminum powders in a suitable binder so that the powder is compacted around the wire mesh to form a sheet-shaped member. Preferably for example where a stoichiometric mixture of such powders for creating an alpha titanium aluminide would comprise a ratio of about 80 to 20 percent by weight of titanium and aluminum powders, the mixture preferably comprises an aluminum rich mixture of about 79% to 21% titanium and aluminum powders. Preferably the powder materials are provided in a wide distribution of particle sizes in the range from about 100 to 325 mesh particle size to be adapted to be compacted with a preferred high density. Preferably the powders are mixed with a conventional heavy molecular weight methacrylate binder such as that sold by DuPont under the trade name Elvacite which may be thinned with a solvent such as a methyl ethyl ketone to a desired consistency to form a powder mixture paste to be compacted around the wire mesh (or to form a slurry to be doctor bladed onto the mesh if preferred). The powder coated and compacted wire mesh would then be heated to a temperature of about 250–400 degrees C. to drive off the binder. It would then be coined at high pressure to achieve a desired density and sintered at about 1000 degrees C. to drive off the binder. It would then be coined at high temperature to achieve a desired density and sintered at about 1000 degrees C. for further consolidating the materials into substantially sold form, for reacting the powder materials with each other to form alpha titanium aluminide material in situ in that form around the wire mesh, and to react the powder materials with surface portions of the wire mesh to form titanium-aluminum intermetallic compounds for securely bonding the alpha titanium aluminide materials to the wire mesh. If desired, the noted process steps are performed in a vacuum or in an inert reducing gas atmosphere. If the wire mesh were advanced continuously to receive the compacted powders and then to be cut into lengths and/or otherwise formed into member 10 of sheet or other shape, such forming steps would be performed prior to the final sintering step at which the powder materials are reacted with each other and with the wire mesh for forming the refractory materials of the member 10.

Figure 2B:
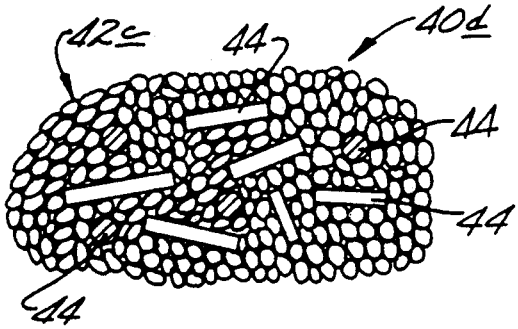
Figure 3B:
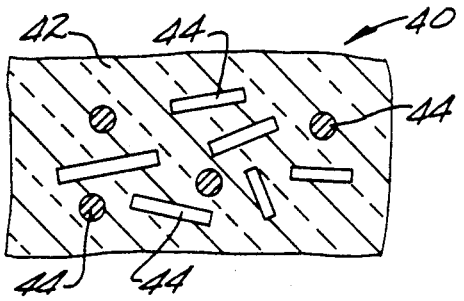

In another alternate embodiment of this invention as illustrated at 40 in FIG. 3B, the member 40 incorporates a refractory metal material 42 similar to the material 12 previously described and is consolidated with reinforcing means comprising a plurality of short lengths of metal wire fiber or metal coated ceramic fiber 44 each having a high length to diameter ratio, the member being formed into a selected tapered shape or the like for example as illustrated in FIG. 3B. In forming that shape, a powder mixture **42*c* corresponding to the powder mixture 12*c* previously described is combined with the reinforcing fibers 44 as illustrated at 40*a* in FIG. 2B so that the fibers are dispersed therein and the powders and reinforcing fibers are consolidated and formed into the selected shape by suitable stamping means such as those diagrammatically indicated at 32 in FIG. 1. The consolidated powder materials of the mixture 42*c*, which may be bonded to each other and to the metal fibers with incipient green bonds as previously described, and the consolidated materials are then heated as previously described for reacting the materials of the metal powders with each other to form the refractory metal material 42 in situ within the selected shape of the member 40 as in forming the member 10**.

EXAMPLE B

In another preferred embodiment of the invention, powder materials as previously described with respect to Example A are compacted around and reacted in situ with a nickel wire for forming a corresponding alph titanium aluminide refractory bonded to the nickel wire mesh by intermetallic compounds comprising nickel aluminides.

Figure 2A:
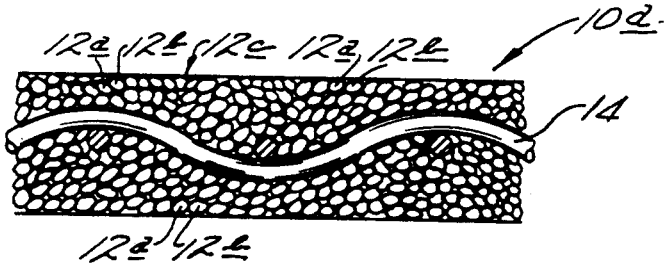
FIGS. 2A, 2B and 2C are section views to enlarged scale along longitudinal axes of stage products produced in alternate embodiments of the methods of this invention.
Figure 2C:
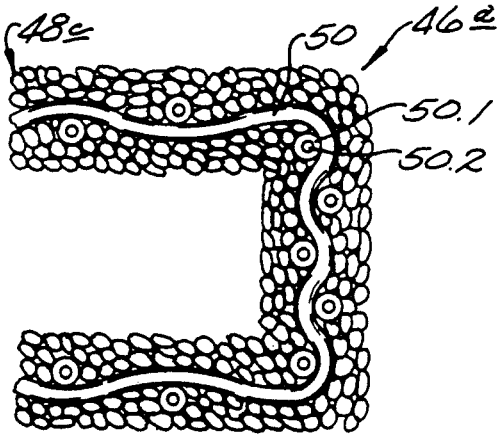
Figure 3C:
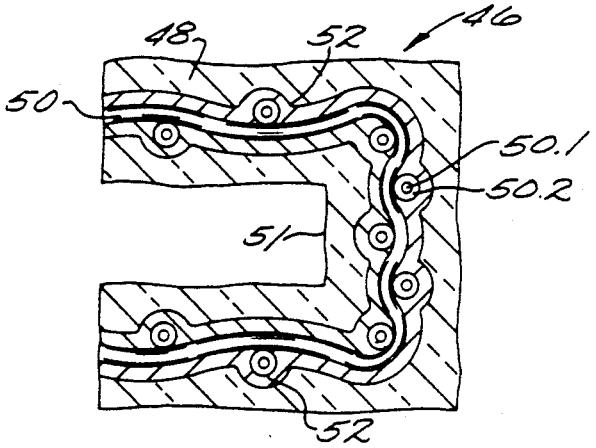

In another preferred embodiment of this invention as illustrated at 46 in FIG. 3C a member 46 embodies a refractory metal material 48 and a metal reinforcing means 50 and is formed into a selected shape such as that of a portion of an engine cowling or the like having a reentrant surface area 51, the reinforcing means 50 extending throughout that selected shape. In this embodiment of this invention the member preferably includes an intermetallic compound 52, which can also be a refractory metal material, formed between the reinforcing means 50 and the refractory metal material 48 as shown in FIG. 3C for securing the reinforcing means 50 in a desired position within the selected shape of the member 46. In forming such a member 46 in a novel and advantageous method of this invention, a mixture of metal powders **48*c* corresponding to the powder mixture 12*c* previously described is consolidated around a metal reinforcing means 50 which also comprises a metal material reactable with at least one of the powdered materials for forming the desired intermetallic compound 52 as indicated at 46*a* in FIG. 2C. Preferably in one preferred embodiment of the invention, the reinforcing means 50 comprises a woven wire mesh embodying a clad metal wire having a core 50.1 of a first metal coated or clad with a second different metal 50.2. Preferably for example, where the mixture 48*c* comprises a mixture of titanium and aluminum powders suitable for forming an alpha titanium aluminide (Ti AL), the reinforcing wire means comprising a high strength titanium wire core material 50.1 having a cladding of 50.2 of aluminum metallurgically bonded to the core thereon. The metal powder mixture 48*c* is consolidated with the woven wire mesh 50 by forging or the like as indicated at 24 and 32 in FIG. 1 for providing the consolidated materials with the selected shape illustrated in FIG. 2C, the coining step 32 being preferably used with an appropriate tool for forming the final shape of the member 46 as will be understood. The consolidated and formed materials are then heated as previously described with reference to FIGS. 2A and 3A for thermally reacting the powders of the mixture 48*c* with each other and with the materials of the reinforcing means 50 for forming the refractory metal material 48 surrounding the reinforcing means 50 in situ within the selected shape 46 and for also forming the intermetallic compound 52, preferably at the same time, between the reinforcing means and the refractory metal material. For example, in one preferred embodiment of the invention, the thickness of the wire cladding 50.2 is regulated relative to the thermal reaction process for forming an intermetallic compound 52 comprising the refractory metal material gamma titanium aluminide (Ti AL) while the stoichiometric mixture of the metal powder 48*c* itself simultaneously forms the refractory metal material 48 comprising alpha titanium aluminide for securely positioning the reinforcing means 50 within the selected shape of the member 46. Alternately, if desired the reinforcing means is formed of titanium wire alone for reacting with the powder material 48*c* to form a corresponding intermetallic compound 52. It should be understood that various other metal materials can also be incorporated in the reinforcing means 50 for forming other intermetallic compounds 52 or the like for providing a secure bond between the reinforcing means 50 and the refractory metal 48** surrounding the reinforcing means.

EXAMPLE C

Figure 1:
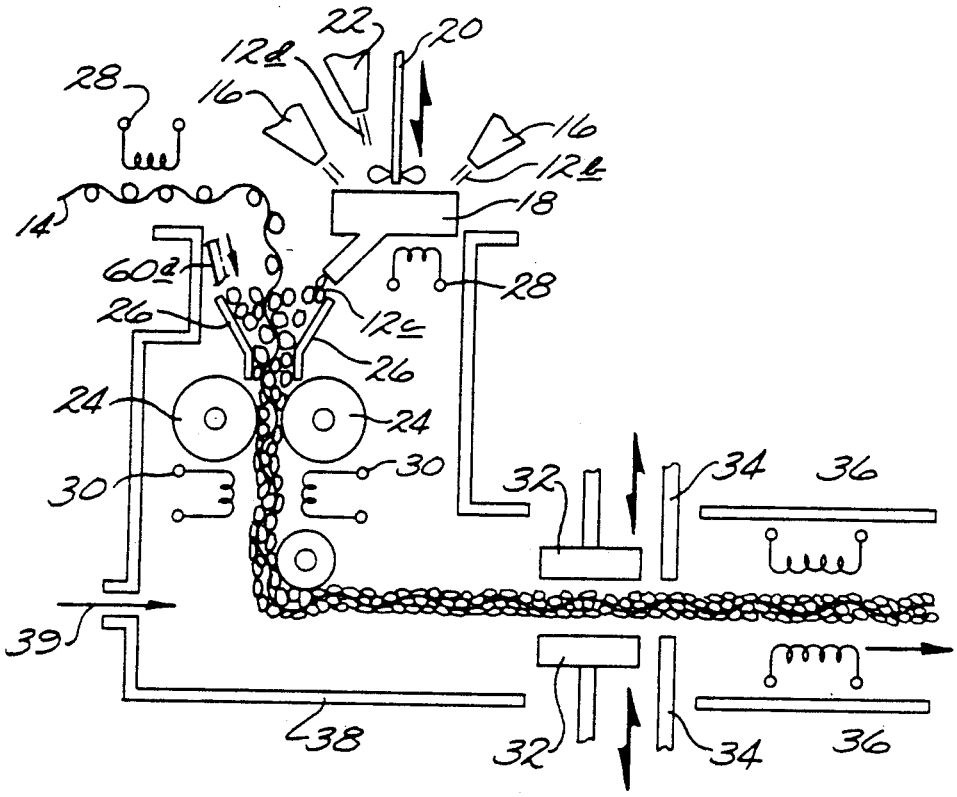
FIG. 1 is a diagrammatic side elevation view of apparatus arranged for carrying out the novel and improved method of this invention.

In another embodiment, particles of metal powders are formed by the conventional RSP or PREP technology from a titanium metal alloy having a nominal composition by weight of 91.5% titanium, 5% niobium and 1% tantalum preferably with particle sizes on the order of 20 microns diameter. The particles are then coated with pure aluminum in any conventional manner. For forming a gamma titanium aluminide, the coating thickness is preferably proportioned so the coated powder material comprises 62% titanium, 32% aluminum, 5% niobium and 1% tantalum. If desired, the coated powders are compacted around a reinforcing wire mesh of a titanium metal alloy or the like. Preferably for example the coated powders are compacted around the wire mesh as illustrated in FIG. 1, and after consolidating by the rolls 24m are sintered for about 2 hours at 250 degrees C. If desired, the compacted and sintered material can be formed into any desired shape, roll-bonded to another metal layer, processed in conventional manner with such a bonded metal layer to form an inflated metal composite or the like, or shaped in any other desired manner. In such shaping processes the compacted and sintered material would have the formability of any aluminum having a particle, and/or particle plus wire mesh, reinforcement. Thereafter, when the compacted, sintered material is in the desired shape, it is placed in furnace and heated to a temperature in the range from about 450–800 degrees C. for a period of several hours to several days for reacting the cores of the particles with their coatings, and the coatings with the wire mesh if used, for in situ forming of the refractory titanium aluminide above described, and for forming titanium aluminide intermetallics for bonding the refractory materials to the wire mesh if used. In that arrangement the desired shape as formed is easily produced using conventional shape forming means and is then reacted to provide a refractory material having that desired shape.

Figure 4A:
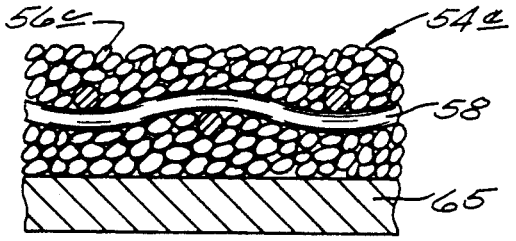
FIGS. 4A and 4B are section views similar to FIGS. 2A and 3A illustrating use of the stage product there illustrated in forming an alternate preferred embodiment of the member of this invention.
Figure 4B:
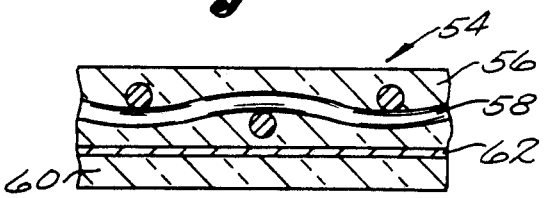

In another alternate embodiment of this invention as illustrated at 54 in FIG. 4B, a member of this invention comprises a refractory metal material 56 surrounding a reinforcing means 58 and also comprises a metal layer 60 metallurgically bonded to the refractory metal material 56. Preferably the other layer 62 is bonded to the refractory metal material 56 by a layer 62 of an intermetallic compound for securely bonding the materials together. Preferably for example, where the refractory metal material 56 comprises a titanium aluminide, the metal layer 60 comprises a thin titanium metal foil or the like. As will be understood from the discussion above, a mixture of metal powders 60*c* corresponding to the mixture 12*c* previously described is consolidated with a reinforcing means corresponding to the reinforcing means 14 and with the metal foil 16 as indicated at 60*a* in FIG. 1 in a manner similar to that previously described to provide a selected shape as shown at 54*a* in FIG. 4A. The consolidated materials are then thermally reacted in a manner corresponding to that previously described for forming the refractory metal material 56 in situ within the selected shape and for forming the intermetallic compound 62 for securing the refractory metal material to the titanium foil.

It should be understood that although particular embodiments of the methods of this invention have been described by way of illustrating the invention, this invention includes all modifications and equivalents of the disclosed embodiments falling within the scope of the appended claims.

We claim:

1. A member of a selected shape substantially formed from a refractory intermetallic compound which comprises titanium aluminide wherein constituents of the refractory intermetallic compound are reacted with each other in situ within the selected shape.

2. A member according to claim 1 in which the refractory intermetallic compound is selected from the group consisting of alpha titanium aluminide and gamma titanium aluminide.

3. A member of a selected shape substantially formed of a refractory intermetalllic compound selected from the group consisting of beryllides and aluminides having reinforcing means disposed therein wherein the refractory intermetallic compound is formed from constituents of the intermetallic compound reacted in situ within the selected shape and an intermetallic compound formed between a constituent of the refractory intermetallic compound and a constituent of the reinforcing means secures the reinforcing means in position within the selected shape.

4. A member according to claim 3 in which the refractory intermetallic compound comprises titanium aluminide.

5. A member according to claim 4 in which the refractory intermetallic compound is selected from the group consisting of alpha titanium aluminide and gamma titanium aluminide.

6. A member according to claim 3 wherein the reinforcing means embody comprise metal wire materials selected from the group consisting of titanium and aluminum.

7. A member according to claim 6 in which the reinforcing means comprises a plurality of wire elements dispersed within the refractory intermetallic compound.

8. A member according to claim 6 in which that the reinforcing means comprises a wire mesh extending throughout the selected shape.

9. A member according to claim 6 in which the wire material comprises a core material having a metal coating thereon.

10. A method for making a member of a selected shape of a refractory intermetallic compound selected from the group consisting of beryllides and aluminides comprising the steps of combining substantially stoichiometric amounts of constituents of the intermetallic compound in finely divided homogeneously mixed powder form, consolidating and forming the constituents into the selected shape, and reacting the constituents in situ within the selected shape to form the refractory intermetallic compound.

11. A method according to claim 10 in which the refractory intermetallic compound comprises titanium aluminide.

12. A method according to claim 11 in which the refractory intermetallic compound is selected from the group consisting of alpha titanium aluminide and gamma titanium aluminide.

13. A method according to claim 10 wherein the constituents of the refractory intermetallic compound are consolidated and formed in the selected shape in surrounding relation to a reinforcing means and the constituents are reacted in situ within the selected shape to form the refractory intermetallic compound.

14. A method according to claim 13 in which the refractory intermetallic compound comprises titanium aluminide.

15. A method according to claim 14 in which the refractory intermetallic compound is selected from the group consisting of alpha titanium aluminide and gamma titanium aluminide.

16. A method according to claim 13 wherein the reinforcing means embodies metal means and a constituent of the metal means is reacted with said constituents of the refractory intermetallic compound in situ within the selected shape to form intermetallic compounds securing the reinforcing means in position within the selected shape.

17. A method according to claim 16 wherein the reinforcing means comprises a wire mesh of titanium metal.

18. A method according to claim 17 wherein the powders are consolidated in said surrounding relation to the wire mesh in a forging step forming incipient metallurgical bonds between the metal powders and between the metal powders and the wire mesh.

19. A method according to claim 16 wherein the wire mesh embodies an aluminum-clad titanium wire and the aluminum clad of the wire is reacted with the metal powders in situ within the selected shape for forming said intermetallic compound between the powders and wire mesh.

20. A method according to claim 16 wherein the powders and wire mesh are consolidated with a titanium metal foil and those consolidated materials are reacted for forming said refractory intermetallic compound surrounding the wire mesh and securely bonding the refractory intermetallic compound to the titanium foil by means of an intermetallic compound formed therebetween.

* * * * *